United States Patent [19]

French

[11] Patent Number: 4,890,406

[45] Date of Patent: Jan. 2, 1990

[54] RAMROD

[75] Inventor: Kendrick L. French, Lebanon, Me.

[73] Assignee: K. W. Thompson Tool Co., Inc., Rochester, N.H.

[21] Appl. No.: 353,079

[22] Filed: May 17, 1989

[51] Int. Cl.[4] ..... F41C 27/00

[52] U.S. Cl. ..... 42/90; 42/95

[58] Field of Search ..... 42/90, 95

[56] References Cited

U.S. PATENT DOCUMENTS

| | | | |
|---|---|---|---|
| 480,746 | 2/1892 | Sandberg . | |
| 553,472 | 1/1896 | Keller | 42/95 |
| 1,526,177 | 2/1925 | Olberding | 15/104.16 |
| 1,665,257 | 4/1928 | Dake . | |
| 2,774,090 | 12/1956 | Allinson | 15/104 |
| 3,205,518 | 9/1965 | Romaine | 15/104 |
| 3,536,160 | 10/1970 | Brewer | 184/1 |
| 4,050,175 | 9/1977 | Mulinix | 42/90 |
| 4,407,086 | 10/1983 | Hasselmann | 42/90 |
| 4,680,824 | 7/1987 | Lieptz | 15/104.16 |
| 4,813,169 | 3/1989 | Calliebe | 42/90 |

*Primary Examiner*—Charles T. Jordan

*Attorney, Agent, or Firm*—Norman S. Blodgett; Gerry A. Blodgett

[57] ABSTRACT

Ramrod having an inner rod formed of glass-reinforced polymer and an outer tube formed of a non-abrasive, heat-shrinkable polymer.

4 Claims, 1 Drawing Sheet

RAMROD

BACKGROUND OF THE INVENTION

Traditionally, ramrods for muzzle-loading guns have been made of wood with metal end pieces for ornamentation and to prevent the wood from splitting. However, the forces brought to bear, when ramming the ball, wad, and powder into the gun barrel, are very large and often lead to breakage of the ramrod. In addition, the wood develops cracks and other forms of deterioration when exposed to rain and cold. Attempts have been made to use other materials than wood, but they have proved to be abrasive and soon lead to substantial wear in the bore of the gun. These and other difficulties experienced with the prior art devices have been obviated in a novel manner by the present invention.

It is therefore, an outstanding object of the invention to provide ramrod for muzzle-loading guns that is strong enough to resist breakage, but which does not abrade the bore of the gun.

Another object of this invention is the provision of a ramrod which is simple in construction, which is inexpensive to manufacture, and which is capable of a long life of useful service with a minimum of maintenance.

A further object of the present invention is the provision of a ramrod that is not damaged by exposure to rain, cold, or heat.

With these and other objects in view, as will be apparent to those skilled in the art, the invention resides in the combination of parts set forth in the specification and covered by the claims appended hereto.

SUMMARY OF THE INVENTION

In general, the invention consists of a ramrod, having an elongated rod formed of a rigid material, and a tube covering a substantial portion of the rod, the tube being formed of a non-abrasive substance.

More specifically, the rod is formed of a glass fibre reinforced polymer and the tube is formed of a heat-shrinkable polymer.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
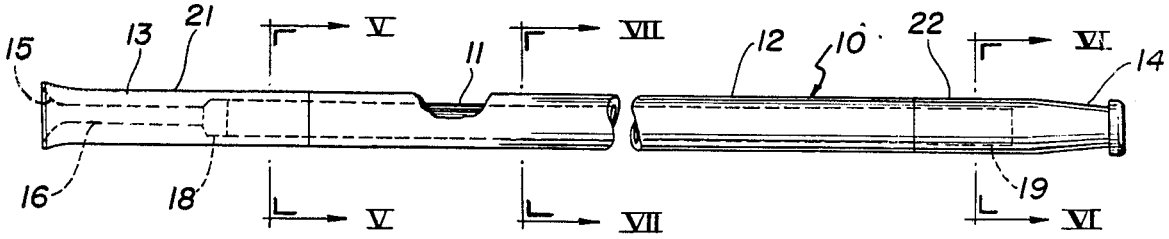
FIG. 1 is a front elevational view of a ramrod constructed in accordance with the principles of the present invention.

Referring first to FIG. 1, wherein are best shown the general features of the invention, the ramrod, indicated generally by the reference number 10, is shown as being elongated in nature. It consists of an elongated rod 11 formed of a rigid material and enveloped by a tube 12 which fits tightly around it. The tube is formed of a nonabrasive material. A cap element 13 is mounted on one end of the rod, while a jag element 14 is mounted on the other end of the rod.

In the preferred embodiment of the invention, the rod 11 is formed of a glass-fibre reinforced polymer. It is ¼" in diameter and is of the HIR grade as manufactured by Glastic Company. The rod has a tensile strength of 90,000 psi, a flexure strength of 100,000 psi, and an IZOD impact strength of 60 ft.-lb./in. The tube 12 is formed of heat-shrinkable tubing manufactured by Schael Associates of Burlington, Mass., U.S.A. under the trademark "THERMOFIT"; more specifically, it consists of a tube of radiation cross-linked polyolefin whose interior is adhesive coated.

Figure 2:
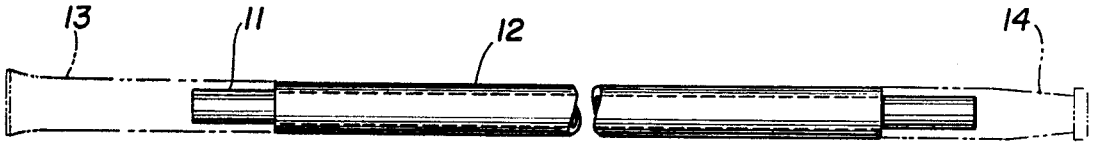
FIG. 2 is a front elevational view of the ramrod at an intermediate condition of its assembly.
Figure 7:
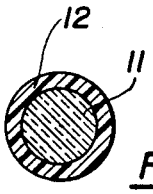
FIG. 7 is a sectional view of the ramrod taken on the lne VII—VII of FIG. 1.

FIG. 2 demonstrates the manner in which the tube 12 is mounted on the rod 11. Before assembly, the tube has an inner diameter that is substantially greater than the diameter of the rod. The tube is slipped over the rod and, since the rod is substantially longer than the tube, portions of the rod extend from both ends of the tube. After the tube has been so located on the rod, heat is applied, which results in shrinkage of the tube to a tight fit around the rod. The adhesive on the inner surface of the tube additionally locks them together as shown in FIG. 7. This results in the assmblage shown in FIG. 2, as it appears before the cap element 13 and the jag element 14 (shown in broken lines) have been added.

Figure 3:
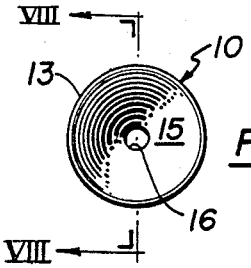
FIG. 3 is an left end elevational view of the ramrod.
Figure 5:
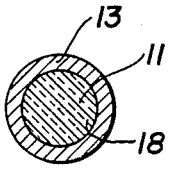
FIG. 5 is a sectional view of the ramrod taken on the line V—V of FIG. 1.
Figure 8:
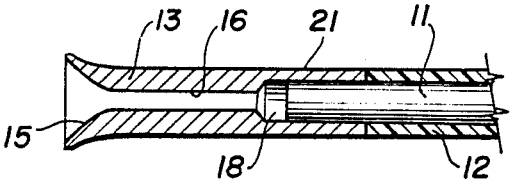
FIG. 8 is a longitudinal sectional view of the ramrod taken on the line VIII—VIII of FIG. 3.

FIGS. 3, 5 and 8 show the details of the cap element 13 and the manner in which it is mounted on the rod 11. The cap element has a flared end with a generally conical recess 15 leading to a relief bore 16 extending through the length of the cap element. The cap element has a shank 21 which has the same outer diameter as the tube 12 and the shank has a counterbore 18 in which the exposed end of the rod 11 lies. The end of the shank 21 engages the adjacent end of the tube 12 to give a smooth joint.

Figure 4:
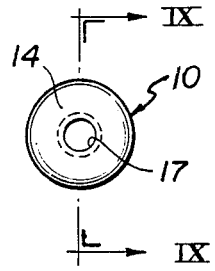
FIG. 4 is a right end elevational view of the ramrod.
Figure 6:
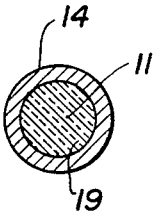
FIG. 6 is a sectional view of the ramrod taken on the line VI—VI of FIG. 1.
Figure 9:
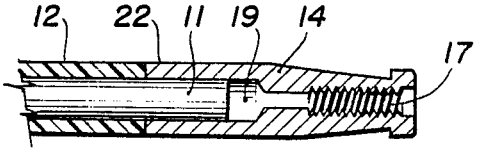
FIG. 9 is a longitudinal sectional view of the ramrod taken on the line IX—IX of FIG. 4.

FIGS. 4, 6 and 9 show the details of construction of the jag element 14 and the manner in which it is mounted on the rod 11. It is provided with a threaded bore 17 adapted to receive a jag or brush used to clean the barrel of the gun. The jag element has a flared end joined by a section of reduced diameter to a shank 22 having the same outer diameter as the tube 12. The shank has a counterbore 19 that fits tightly over the portion of the rod that extends out of the tube. The end of the shank engages the adjacent end of the tube to form a smooth junction.

The cap element 13 and the jag element 14 are formed of a soft metal, such as copper, that will not scratch the bore of the gun. They are fastened to the rod 11 by means of a high-temperature adhesive sold under the trademark PERMABOUND 240 manufactured by the National Starch and Chemical Corp. of Bridgewater, N.J.

The operation and advantages of the instant invention will now be readily understood in view of the above description. The ramrod is used primarily to pack the ball, wadding, and powder tightly into the chamber end of the gun barrel. For that purpose, the cap element 13 is introduced into the barrel until the conical recess engages the ball or other projectile. Several thrusts with considerable force are necessary to drive the ball and other elements tightly into place. The strength of the rod 11 makes it possible to use considerable force without the danger of breaking the ramrod. When the gun needs cleaning; the jag element 14 is introduced into the barrel with a brush (not shown) mounted in the threaded bore 17.

As is evident, the engagement of the outer surface of the tube 12 with the surface of the bore of the gun will not cause abrasion, because of the non-abrasive nature of the polymer from which the tube is formed. At the same time, all of the elements making up the ramrod are resistant to the rain, cold, heat, and the like that are often encountered in the outdoors where the gun and the ramrod are used. In addition, any products of the combustion of the gun powder will not effect the ramrod chemically and can be easily removed by washing.

It is obvious that minor changes may be made in the form and construction of the invention without departing from the material spirit thereof. It is not, however desired to confine the invention to the exact form herein shown and described, but it is desired to include all such as properly come within the scope claimed.

The invention having been thus described, what is claimed as new and desired to secure by Letters Patent is:

1. A ramrod, comprising:

(a) an elongated rod having a first and a second end and formed of a rigid material, and (b) a tube covering a substantial portion of the rod, the tube being formed of a non-abrasive substance wherein the rod is formed of a glass-fibre reinforced polymer, and wherein the tube is formed of a heat-shrinkable polymer.

2. A ramrod, comprising:

(a) an elongated rod having a first and a second end and formed of a rigid material, and (b) a tube covering a substantial portion of the rod, the tube being formed of a non-abrasive substance, wherein a cap element is mounted on the first end of the rod, wherein a jag element is mounted on the second end of the rod, and wherein the cap element has a conical recess on its end face and an axially-extending relief bore extending through its length.

3. A ramrod as recited in claim 2, wherein the jag element has an axially-extending threaded bore extending into its end.

4. A ramrod as recited in claim 2, wherein the cap element and the jag element each have an inward shank lying adjacent its respective end of the tube and having the same diameter as the tube.

* * * * *